US011661960B2

(12) United States Patent
Takakuwa et al.

(10) Patent No.: US 11,661,960 B2
(45) Date of Patent: May 30, 2023

(54) PRESSURE-BOOSTER OUTPUT STABILIZER

(71) Applicant: SMC CORPORATION, Tokyo (JP)

(72) Inventors: Youji Takakuwa, Kitakatsushika-gun (JP); Kazufumi Waki, Moriya (JP)

(73) Assignee: SMC CORPORATION, Tokyo (JP)

( * ) Notice: Subject to any disclaimer, the term of this patent is extended or adjusted under 35 U.S.C. 154(b) by 62 days.

(21) Appl. No.: 17/210,569

(22) Filed: Mar. 24, 2021

(65) Prior Publication Data

US 2021/0301839 A1 Sep. 30, 2021

(30) Foreign Application Priority Data

Mar. 27, 2020 (JP) ..... JP2020-058079

(51) Int. Cl.
*F15B 11/032* (2006.01)
*F15B 3/00* (2006.01)

(52) U.S. Cl.
CPC ..... *F15B 11/032* (2013.01); *F15B 3/00* (2013.01); *F15B 2211/214* (2013.01)

(58) Field of Classification Search
CPC . F15B 11/032; F15B 11/036; F15B 2211/214; F04B 9/1053; F04B 9/1253
See application file for complete search history.

(56) References Cited

U.S. PATENT DOCUMENTS 3,186,173 A * 6/1965 Hogg ..... F15B 3/00 60/563
4,051,877 A * 10/1977 Fletcher ..... F04B 39/0016 60/560
4,309,156 A * 1/1982 Gonner ..... F04B 9/107 417/403
5,435,228 A * 7/1995 Snitgen ..... F15B 3/00 60/426
6,126,413 A * 10/2000 Berke-Jørgensen .... F04B 23/04 417/46
6,266,959 B1 7/2001 Markwart
10,876,550 B2 * 12/2020 Asaba ..... F15B 9/08
(Continued)

FOREIGN PATENT DOCUMENTS

JP 2018-084270 A 5/2018
WO WO 97/42417 A1 11/1937
(Continued)

OTHER PUBLICATIONS

Extended European Search Report dated Jul. 22, 2021 in European Patent Application No. 21164460.4, 7 pages.

*Primary Examiner* — Kenneth Bomberg
*Assistant Examiner* — Matthew Wiblin
(74) *Attorney, Agent, or Firm* — Oblon, McClelland, Maier & Neustadt, L.L.P.

(57) ABSTRACT

A pressure-booster output stabilizer includes: a first cylinder having therein a first chamber and a second chamber separated by a first piston; a second cylinder having therein a third chamber and a fourth chamber separated by a second piston; and a piston rod configured to couple the first piston and the second piston. The primary pressure of a pressure booster is supplied to the first chamber, the secondary pressure of the pressure booster is supplied to the fourth chamber, and the pressurized fluid is taken out from the fourth chamber.

6 Claims, 9 Drawing Sheets

(56) References Cited

U.S. PATENT DOCUMENTS

| | | | | |
|---|---|---|---|---|
| 2007/0193797 | A1* | 8/2007 | Shamis | F04B 9/127 180/165 |
| 2020/0063760 | A1 | 2/2020 | Asahara et al. | |
| 2021/0102558 | A1 | 4/2021 | Asahara | |

FOREIGN PATENT DOCUMENTS

| | | |
|---|---|---|
| WO | WO 2811/154101 | 12/2011 |
| WO | WO 2018/198535 A | 11/2018 |

* cited by examiner

70

PRESSURE-BOOSTER OUTPUT STABILIZER

CROSS-REFERENCE TO RELATED APPLICATION

This application is based upon and claims the benefit of priority from Japanese Patent Application No. 2020-058079 filed on Mar. 27, 2020, the contents of which are incorporated herein by reference.

BACKGROUND OF THE INVENTION

Field of the Invention

The present invention relates to a pressure-booster output stabilizer combined with a fluid pressure booster.

Description of the Related Art

Conventionally, there has been known a pressure booster that pressure-boosts air of a primary pressure supplied from a compressor and outputs the air at a predetermined secondary pressure.

As a pressure booster of this kind, for example, Japanese Laid-Open Patent Publication No. 2018-084270 discloses a configuration in which drive cylinders are arranged on both sides of a pressure boosting cylinder. As described in the same document, the pressure-boosted fluid output from the pressure booster is usually stored in an external tank and used in such a form as to be supplied from the tank to a fluid pressure device.

SUMMARY OF THE INVENTION

However, when the amount of fluid used in the fluid pressure device greatly exceeds the discharge rate of flow from the pressure booster, the pressurized fluid stored in the tank is rapidly consumed, so that the pressure in the tank drops sharply in a short time. Therefore, it is likely that the fluid with a sufficient pressure becomes unable to be supplied to the fluid pressure device. In addition, there is a concern that the pressure booster is operated at higher speed, resulting in increased consumption of the pressurized fluid, and that the life of the pressure booster is shortened.

The present invention has been devised in view of the circumstances described above, and it is an object of the present invention to provide a pressure-booster output stabilizer capable of outputting the secondary pressure of a pressure booster in a stable condition.

A pressure-booster output stabilizer according to the present invention is connected to a fluid pressure booster that outputs a predetermined secondary pressure from a primary pressure, and includes: a first cylinder having therein a first chamber and a second chamber separated by a first piston; a second cylinder having therein a third chamber and a fourth chamber separated by a second piston; and a piston rod configured to couple the first piston and the second piston. In this configuration, the primary pressure is supplied to the first chamber, the secondary pressure is supplied to the fourth chamber, and a pressurized fluid is taken out from the fourth chamber.

According to the above pressure-booster output stabilizer, the pressurized fluid taken out from the fourth chamber of the second cylinder can be kept at a pressure close to the secondary pressure set by the pressure booster and output at a stable pressure. Further, since the operating speed of the pressure booster can be slowed down, the consumption of the pressurized fluid can be reduced and the life of the pressure booster can be extended.

Since the pressure-booster output stabilizer according to the present invention has a configuration in which the first piston on which the primary pressure of the pressure booster acts and the second piston on which the secondary pressure of the pressure booster acts are connected, and the pressurized fluid is taken out from a chamber to which the pressurized fluid of the secondary pressure is supplied, the secondary pressure of the pressure booster can be output in a stable condition. In addition, since the operating speed of the pressure booster becomes slower, the consumption of pressurized fluid is reduced and the durability of the pressure booster is enhanced.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Now, an example of a fluid pressure booster to be used in combination with a pressure-booster output stabilizer according to the present invention will be described first, and then preferred embodiments of the pressure-booster output stabilizer according to the present invention will be described with reference to the accompanying drawings. The fluid used is a pressurized fluid such as compressed air.

(Example of Pressure Booster)

Figure 1:
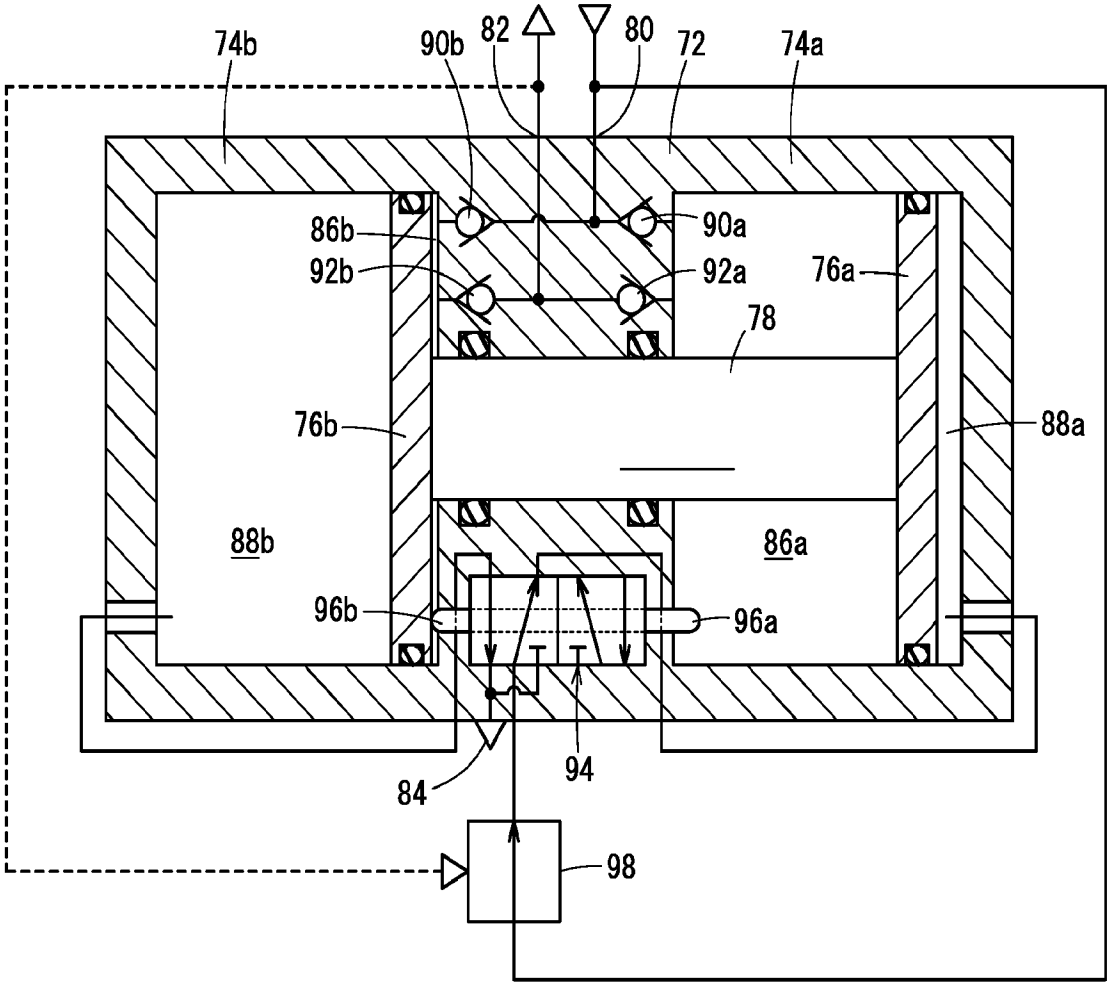
FIG. 1 is a diagram showing an example of a pressure booster combined with the pressure-booster output stabilizer according to the present invention.

As illustrated in FIG. 1, the fluid pressure booster (pressure booster) 70 combined with the pressure-booster output stabilizer according to the present invention includes a center body 72, a pair of cylinders 74*a* and 74*b* connected respectively to both sides of the center body 72, pistons 76*a* and 76*b* sliding in the respective cylinders 74*a* and 74*b*, and a rod 78 connecting the pistons 76*a* and 76*b*. The center body 72 has an inlet port 80, an outlet port 82, and a discharge port 84, and the inlet port 80 is connected to an unillustrated fluid supply source (compressor).

The cylinders 74*a*, 74*b* are divided into inner boost chambers 86*a*, 86*b* and outer drive chambers 88*a*, 88*b* by pistons 76*a*, 76*b*. The boost chambers 86*a* and 86*b* communicate with the inlet port 80 via inlet check valves 90*a* and 90*b* provided in the center body 72, and also communicate with the outlet port 82 via outlet check valves 92*a* and 92*b*. The drive chambers 88*a* and 88*b* are connected to a switching valve 94 installed in the center body 72, and push rods 96*a* and 96*b* for switching the switching valve 94 are projected into the boost chambers 86*a* and 86*b*, respectively. The pressure booster 70 also includes a governor 98 for adjusting the secondary pressure of the fluid at the outlet port 82.

In this pressure booster 70, when the piston 76*a* moves to the left in FIG. 1 by the pressurized fluid supplied to the first drive chamber 88*a* via the switching valve 94, the pressurized fluid in the first boost chamber 86*a* is pressure-boosted, and output from the outlet port 82 through the outlet check valve 92*a*. During this process, the pressurized fluid in the second drive chamber 88*b* is discharged from the discharge port 84 via the switching valve 94. Then, when the piston 76*a* moves and pushes the push rod 96*a* near a stroke end thereof, the switching valve 94 is changed over, so that the pressurized fluid is supplied to the second drive chamber 88*b*.

As a result, the piston 76*b* moves to the right in FIG. 1, so that the pressurized fluid in the second boost chamber 86*b* is pressure-boosted, and output from the outlet port 82 through the outlet check valve 92*b*. During this process, the pressurized fluid in the first drive chamber 88*a* is discharged from the discharge port 84 via the switching valve 94. Then, when the piston 76*b* moves and pushes the push rod 96*b* near a stroke end thereof, the switching valve 94 switches to a state shown in the figure. The pressure booster 70 repeats the above series of operations until the pressure of the fluid at the outlet port 82 reaches a set secondary pressure.

First Embodiment

Next, a pressure-booster output stabilizer 10 according to the first embodiment of the present invention will be described with reference to FIGS. 2 to 7.

Figure 4:
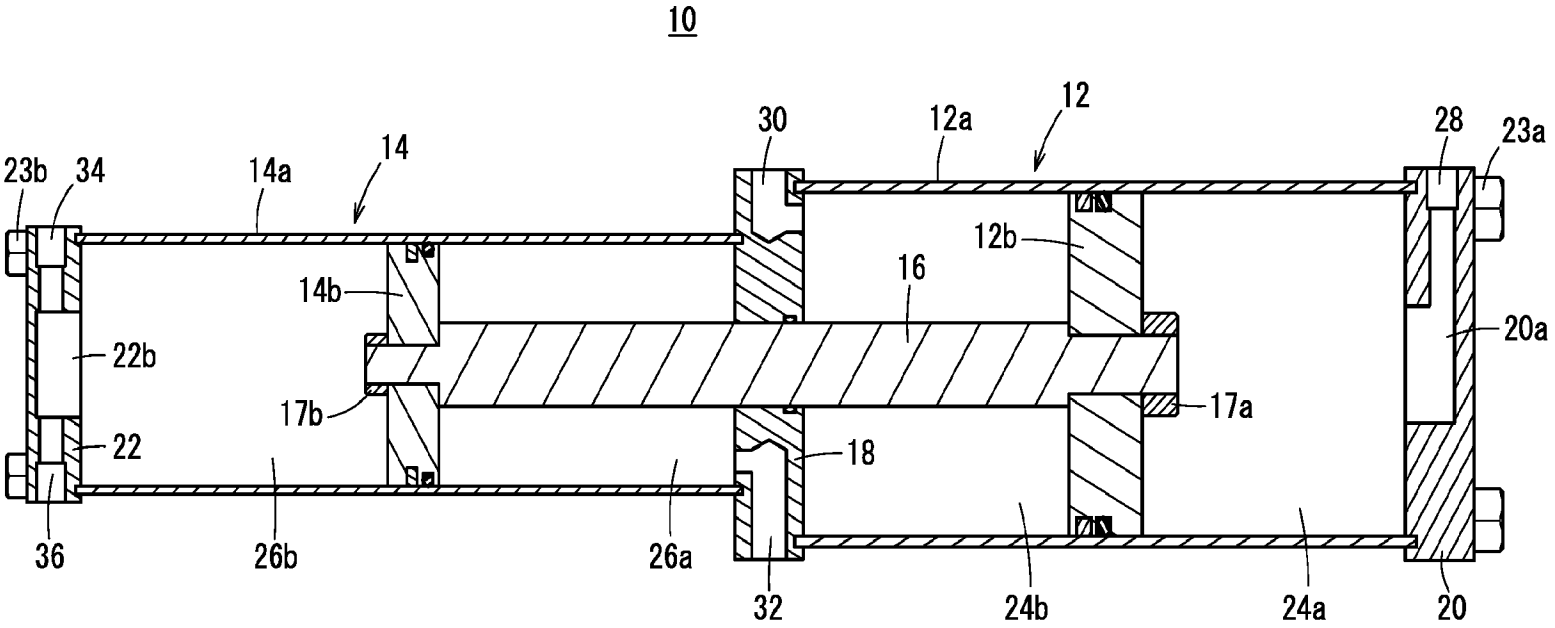
FIG. 4 is a sectional view taken along a line IV-IV of the pressure-booster output stabilizer of FIG. 2.
Figure 5:
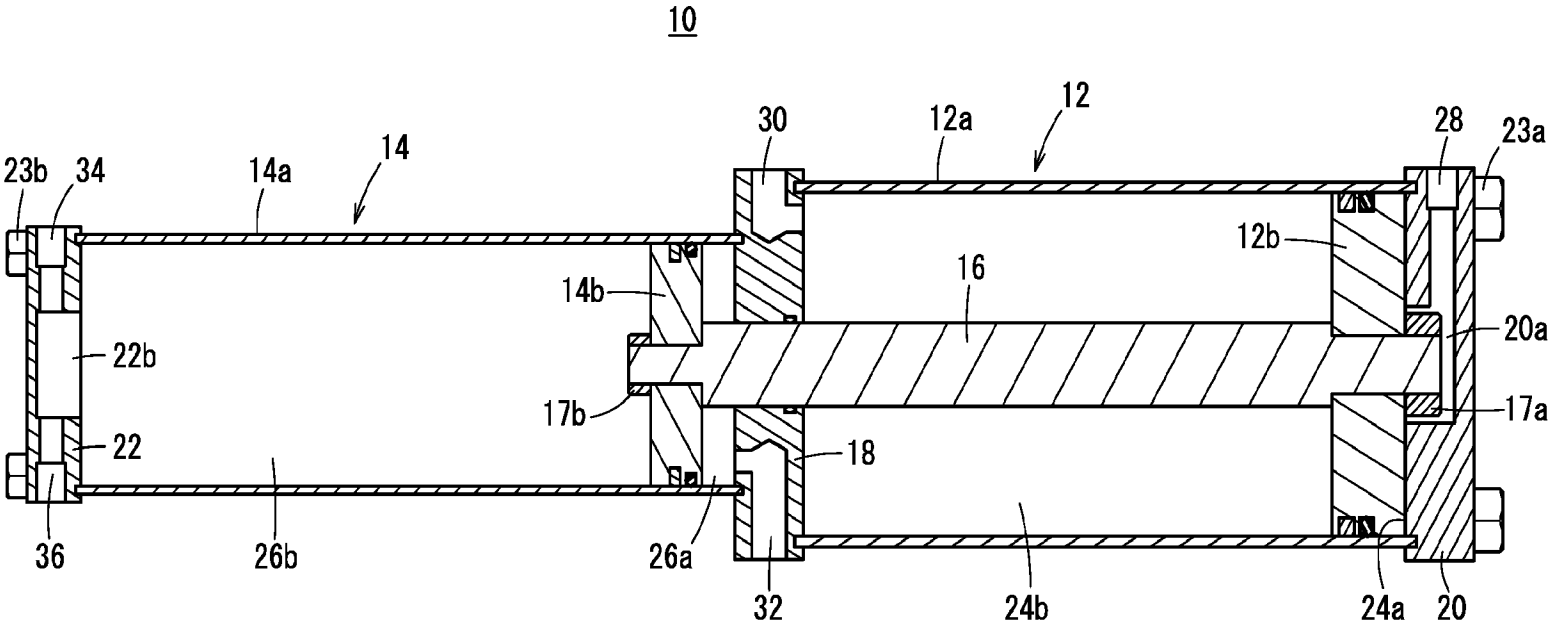
FIG. 5 is a diagram corresponding to FIG. 4 when the pressure-booster output stabilizer of FIG. 2 is in a predetermined operating position.

As shown in FIG. 4, the pressure-booster output stabilizer 10 includes a first cylinder 12 and a second cylinder 14 connected in series. The first cylinder 12 has a rectangular parallelepiped first cylinder tube 12*a* and a circular first piston 12*b* slidably arranged in a circular cylinder hole formed in the first cylinder tube 12*a*. The second cylinder 14 has a rectangular parallelepiped second cylinder tube 14*a* and a circular second piston 14*b* slidably arranged in a circular cylinder hole formed in the second cylinder tube 14*a*.

The first piston 12*b* is connected and fixed to one end side of the piston rod 16 by a first nut 17*a*, and the second piston 14*b* is connected and fixed to the other end side of the piston rod 16 by a second nut 17*b*. Therefore, the first piston 12*b* and the second piston 14*b* move together with the piston rod 16 in the axial direction. The outside diameter of the first piston 12*b* is greater than the outside diameter of the second piston 14*b*.

A rectangular plate-shaped middle cover 18 is provided between the first cylinder tube 12*a* and the second cylinder tube 14*a*. A rectangular plate-shaped first end cover 20 is provided on an end side of the first cylinder tube 12*a* that is farther away from the middle cover 18, whereas a rectangular plate-shaped second end cover 22 is provided on an end side of the second cylinder tube 14*a* that is farther away from the middle cover 18. The assembly formed of the first piston 12*b*, the second piston 14*b*, and the piston rod 16 (hereinafter referred to as "piston assembly") is configured to be able to move between a position where the first piston 12*b* abuts against the first end cover 20 (see FIG. 5) and a position where the first piston 12*b* abuts against the middle cover 18 (see FIG. 6).

Figure 3:
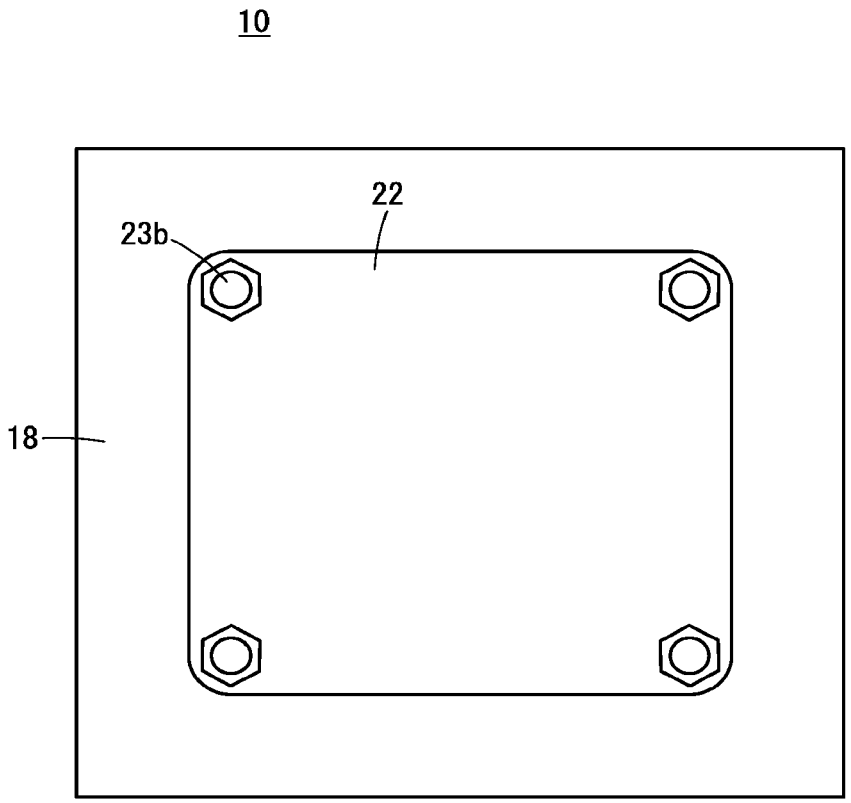
FIG. 3 is a side view of the pressure-booster output stabilizer of FIG. 2.

The first cylinder tube 12*a* is sandwiched and held between the first end cover 20 and the middle cover 18 by four bolts 23*a* being inserted from the first end cover 20 side and screwed into the middle cover 18. The second cylinder tube 14*a* is sandwiched and held between the second end cover 22 and the middle cover 18 by four bolts 23*b* being inserted from the second end cover 22 side and screwed into the middle cover 18 (FIG. 3).

The inside of the cylinder hole of the first cylinder tube 12*a* is partitioned into a first chamber 24*a* on the first end cover 20 side and a second chamber 24*b* on the middle cover 18 side by the first piston 12*b*. The inside of the cylinder hole of the second cylinder tube 14*a* is partitioned into a third chamber 26*a* on the middle cover 18 side and a fourth chamber 26*b* on the second end cover 22 side by the second piston 14*b*.

Figure 2:
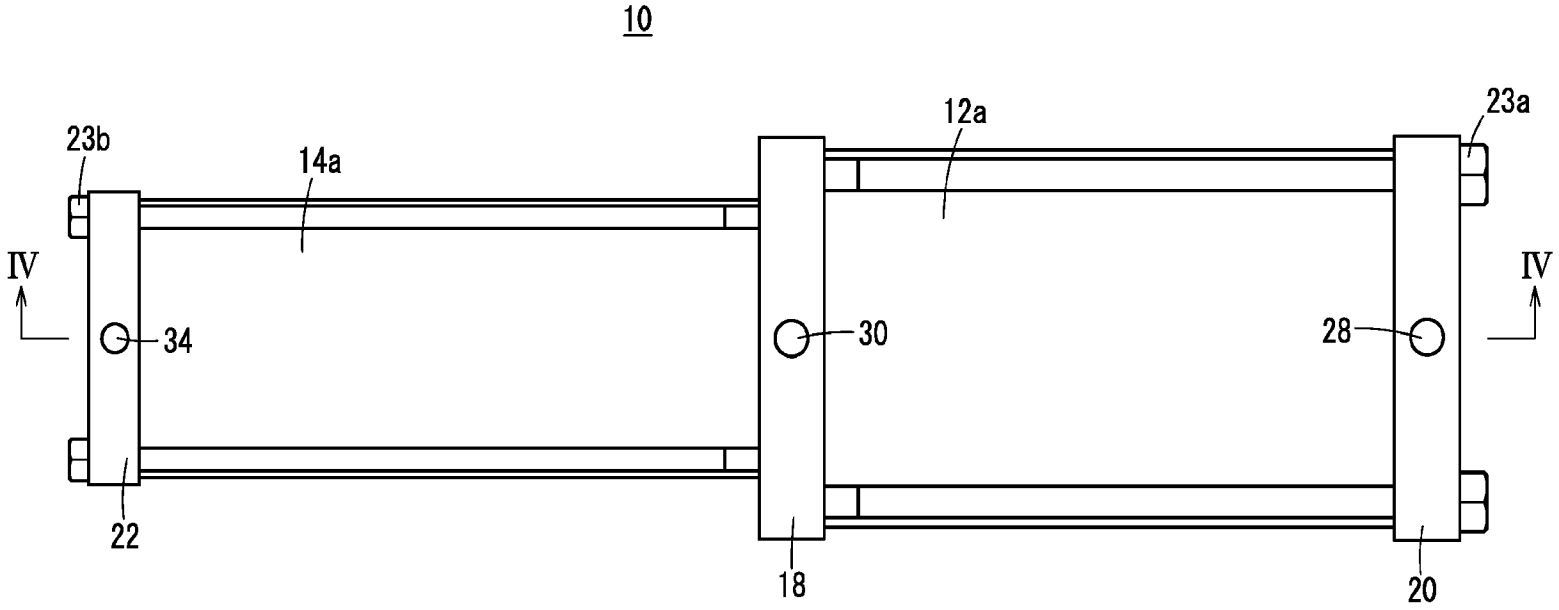
FIG. 2 is a plan view of a pressure-booster output stabilizer according to a first embodiment of the present invention.

As shown in FIGS. 2 and 4, one side surface of the first end cover 20 is formed with a primary pressure supply port 28 connected to the aforementioned fluid supply source. The pressurized fluid from the fluid supply source is supplied to the inlet port 80 of the pressure booster 70 and also to the primary pressure supply port 28. Therefore, the pressure of the fluid supplied to the first chamber 24*a* of the first cylinder 12 via the primary pressure supply port 28 is the same as that of the fluid supplied to the inlet port 80 of the pressure booster 70 (i.e., the primary pressure of the pressure booster 70).

The middle cover 18 includes, formed on one side surface thereof, a first breathing port 30 that opens to the atmosphere. A second breathing port 32 that opens to the atmosphere is formed on the other side surface of the middle cover 18 opposite to the one side surface. The second chamber 24*b* of the first cylinder 12 is opened to the atmosphere through the first breathing port 30, and the third chamber 26*a* of the second cylinder 14 is opened to the atmosphere through the second breathing port 32.

The second end cover 22 includes, formed on one side surface thereof, a secondary pressure supply port 34 that is connected to the outlet port 82 of the pressure booster 70 by an unillustrated tube. The pressurized fluid output from the pressure booster 70 is supplied to the fourth chamber 26*b* of the second cylinder 14 via the secondary pressure supply port 34. The pressure of the fluid at the secondary pressure supply port 34 is the same as the pressure of the fluid at the outlet port 82 of the pressure booster 70 (i.e., the secondary pressure of the pressure booster 70). An output port 36 is provided on the other side surface of the second end cover 22 opposite to the one side surface where the secondary pressure supply port 34 is provided, and the pressurized fluid in the fourth chamber 26*b* of the second cylinder 14 can be taken out from the output port 36 and supplied to an unillustrated fluid pressure device.

The first end cover 20 is provided with a hollow 20*a* that allows the primary pressure supply port 28 to communicate with the first chamber 24*a* of the first cylinder 12 and that is capable of accommodating the first nut 17*a* therein. The second end cover 22 is provided with a hollow 22*b* that allows the secondary pressure supply port 34 and the output port 36 to communicate with the fourth chamber 26*b* of the second cylinder 14.

Now, the pressure of the first chamber 24*a*, that is, the primary pressure of the pressure booster 70, is denoted by $P_1$, the pressure of the fourth chamber 26*b* at which the forces acting on the piston assembly are balanced is denoted by $P_2'$, and the secondary pressure set by the pressure booster 70 is dented by $P_2$. $P_2'$ can be determined based on $P_1$, the cross-sectional area of the first piston 12*b*, and the cross-sectional area of the second piston 14*b*.

In order to maintain the pressure of the fluid taken out from the fourth chamber 26*b* at a value close to the secondary pressure $P_2$ set by the pressure booster, it is preferable that $P_2'$ be a value as close to $P_2$ as possible. Further, $P_2'$ needs to be $P_2$ or lower in order that the volume of the fourth chamber 26*b* can be restored after the piston assembly has moved until the volume of the fourth chamber 26*b* is minimized.

The pressure-booster output stabilizer 10 according to the present embodiment is basically configured as described above, and its operation will be described below. The initial state is assumed such that the pressures of the first to fourth chambers 24*a* to 26*b* are all equal to the atmospheric pressure and the piston assembly stands still at the position shown in FIG. 4. In this initial state, the pressure booster 70 is not operating. It is also assumed that the unillustrated flow path connecting the output port 36 and the fluid pressure device is closed by an unillustrated solenoid valve.

By switching an unillustrated switching valve from the above initial state, the pressurized fluid is supplied from the fluid supply source to the pressure booster 70 and the pressure-booster output stabilizer 10. As a result, the pressurized fluid having the primary pressure $P_1$ is supplied to the inlet port 80 of the pressure booster 70, and at the same time, the pressurized fluid having the primary pressure $P_1$ is also supplied to the primary pressure supply port 28 of the pressure-booster output stabilizer 10. The pressurized fluid is supplied from the primary pressure supply port 28 to the first chamber 24*a* of the first cylinder 12.

As (fluid having) the primary pressure is supplied to the inlet port 80 of the pressure booster 70, operation of the pressure booster 70 is started, and the pressure-boosted fluid is supplied from the outlet port 82 of the pressure booster 70 toward the secondary pressure supply port 34 of the pressure-booster output stabilizer 10. When the pressure booster 70 operates for a certain time period or more, the pressure in the fourth chamber 26*b* of the second cylinder 14 to which the pressurized fluid has been supplied through the secondary pressure supply port 34 reaches the secondary pressure $P_2$ set by the pressure booster 70, and exceeds the pressure $P_2'$ at which the aforementioned piston assembly maintains balance. As a result, the piston assembly moves until the first piston 12*b* abuts against the first end cover 20, and the pressurized fluid having the secondary pressure $P_2$ set by the pressure booster 70 is stored in the fourth chamber 26*b* of the second cylinder 14 (see FIG. 5).

When the flow path connecting the output port 36 and the fluid pressure device is opened from the state in which the pressurized fluid having the secondary pressure $P_2$ has been stored in the fourth chamber 26*b* of the second cylinder 14, the pressurized fluid stored in the fourth chamber 26*b* is supplied through the output port 36 toward the fluid pressure device. As the pressurized fluid stored in the fourth chamber 26*b* is taken out from the output port 36, the piston assembly, to maintain the balance of the forces applied to the piston assembly, moves in such a way that the first piston 12*b* moves away from the first end cover 20 and the second piston 14*b* moves close to the second end cover 22.

As a result, the volume of the fourth chamber 26*b* is reduced to thereby suppress the pressure drop. The pressure of the fourth chamber 26*b* is maintained so as not to fall at least below $P_2'$. When the pressure in the fourth chamber 26*b* falls below the secondary pressure $P_2$ set by the pressure booster 70, the pressure booster 70 operates, but its operating speed is relatively moderate. In this way, the piston assembly moves to reduce the volume of the fourth chamber 26*b*. Moreover, the pressurized fluid having the secondary pressure $P_2$ is replenished to the fourth chamber 26*b* from the outlet port 82 of the pressure booster 70 and the pressurized fluid is drawn out from the fourth chamber 26*b*. Thus, it is possible to send out the pressurized fluid to the fluid pressure device at a stable pressure.

When the fluid pressure device stops using the pressurized fluid in a state where the first piston 12*b* is located at an intermediate position between the first end cover 20 and the middle cover 18, since the pressurized fluid having the secondary pressure $P_2$ is supplied from the outlet port 82 of the pressure booster 70 to the fourth chamber 26*b*, the piston assembly moves until the first piston 12*b* abuts against the first end cover 20. As a result, the volume of the fourth chamber 26*b* is restored to the maximum.

Figure 6:
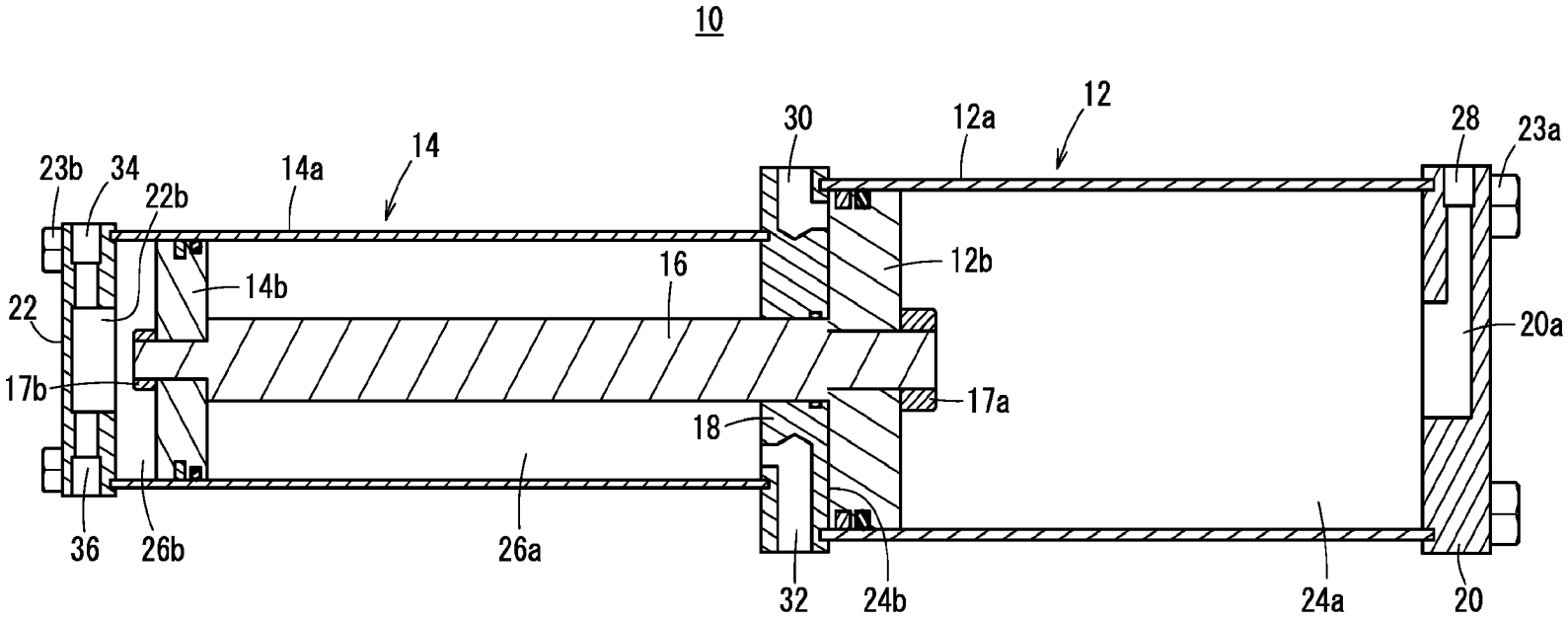
FIG. 6 is a diagram corresponding to FIG. 4 when the pressure-booster output stabilizer of FIG. 2 is in a different operating position.

When the fluid pressure device has continuously used an extremely large amount of pressurized fluid and the pressurized fluid stored in the fourth chamber 26*b* has been rapidly consumed, the piston assembly moves until the first piston 12*b* abuts against the middle cover 18, so the volume of the fourth chamber 26*b* is minimized (see FIG. 6). In this case, substantial operation is performed by the pressure booster 70 only, but when the amount of the pressurized fluid used in the fluid pressure device decreases or becomes zero, the volume of the fourth chamber 26*b* is restored again.

Figure 7:
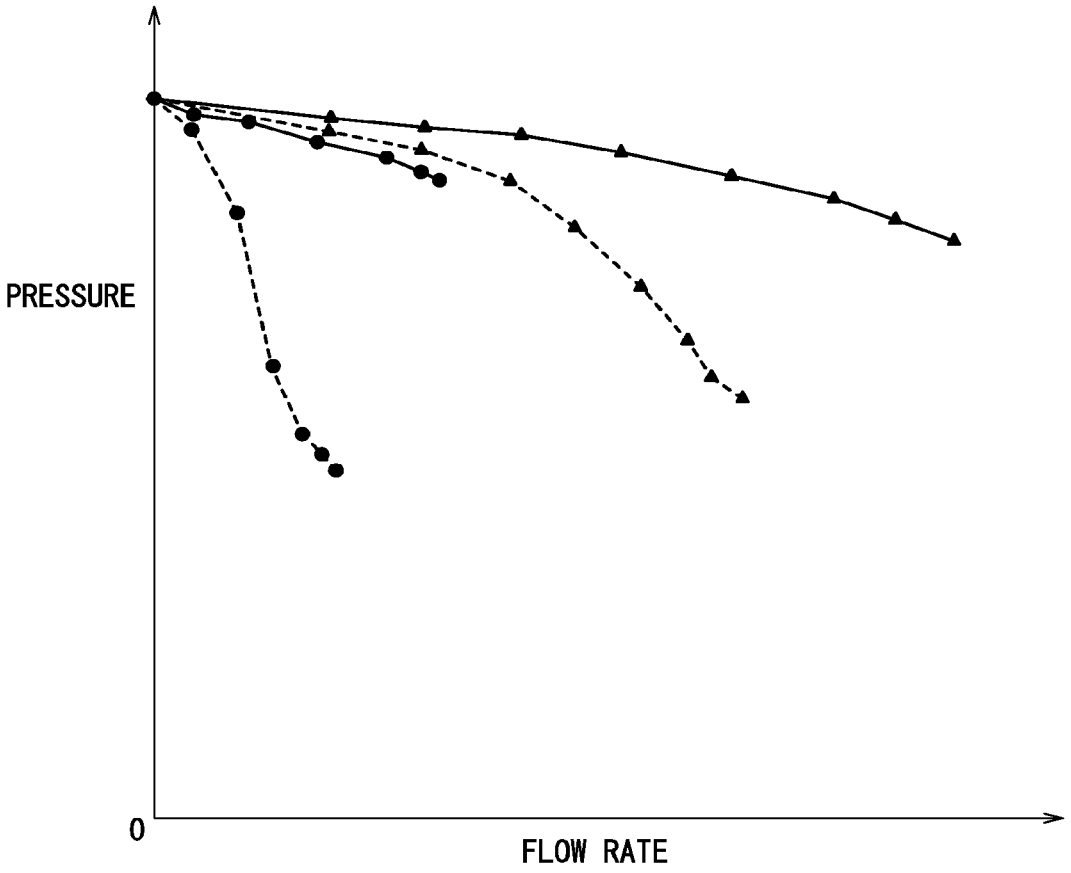
FIG. 7 is a diagram showing the relationships between the flow rate of fluid output from the pressure-booster output stabilizer of FIG. 2 and the pressure.

FIG. 7 is a diagram showing the relationship between the pressure and the flow rate of the pressurized fluid taken out, for two pressure boosters having different sizes, each with and without the pressure-booster output stabilizer. The horizontal axis represents the flow rate, and the vertical axis represents the pressure. A graph of circle points joined with a dotted line shows a case where a small pressure booster is used alone, and a graph of circle points joined with a solid line shows a case where the small pressure booster is used in combination with the pressure-booster output stabilizer. A graph of triangular points joined with a dotted line shows a case where a medium-sized pressure booster is used alone, and a graph of triangular points joined with a solid line shows a case where the medium-sized pressure booster is used in combination with the pressure-booster output stabilizer.

As can be understood from FIG. 7, use of the pressure-booster output stabilizer in combination suppresses the pressure drop when the flow rate increases. Further, combined use of the pressure-booster output stabilizer enables even a small pressure booster to have a capacity equivalent to a pressure booster of one size higher.

According to the pressure-booster output stabilizer 10 of the present embodiment, the first piston 12*b* on which the primary pressure of the pressure booster 70 acts and the second piston 14*b* on which the secondary pressure of the pressure booster 70 acts are coupled, and the pressurized fluid is taken out from the fourth chamber 26*b* to which (the fluid having) the secondary pressure is supplied. Thus, the pressurized fluid can be output at a stable pressure close to the secondary pressure of the pressure booster 70. Further, since the operating speed of the pressure booster 70 is moderate, the amount of pressure fluid discharged from the discharge port 84 is reduced, whereby it is possible to reduce the consumption of pressure fluid and improve the durability of the pressure booster 70 as well.

Second Embodiment

Figure 8:
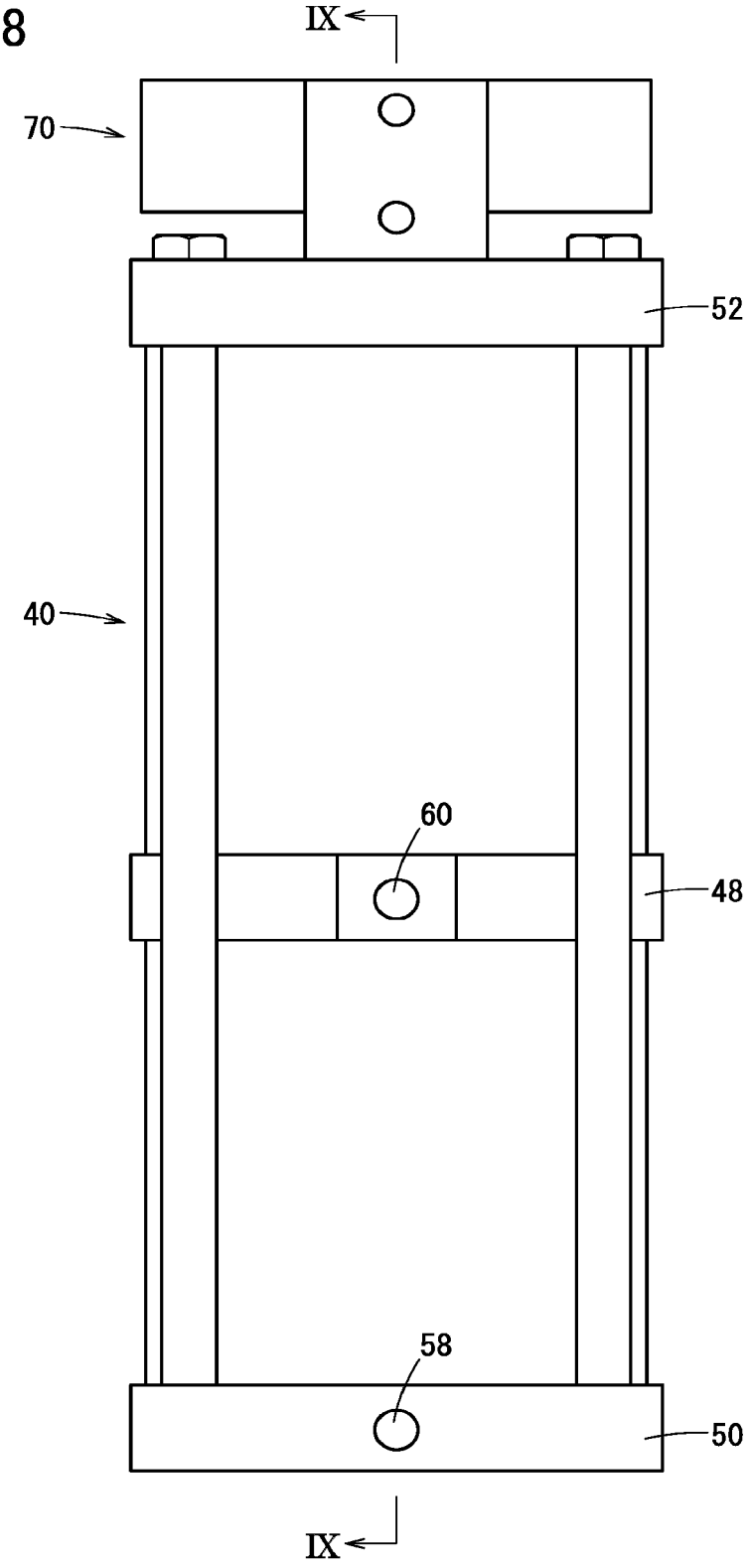
FIG. 8 is a front view of a pressure-booster output stabilizer and a pressure booster according to a second embodiment of the present invention.
Figure 9:
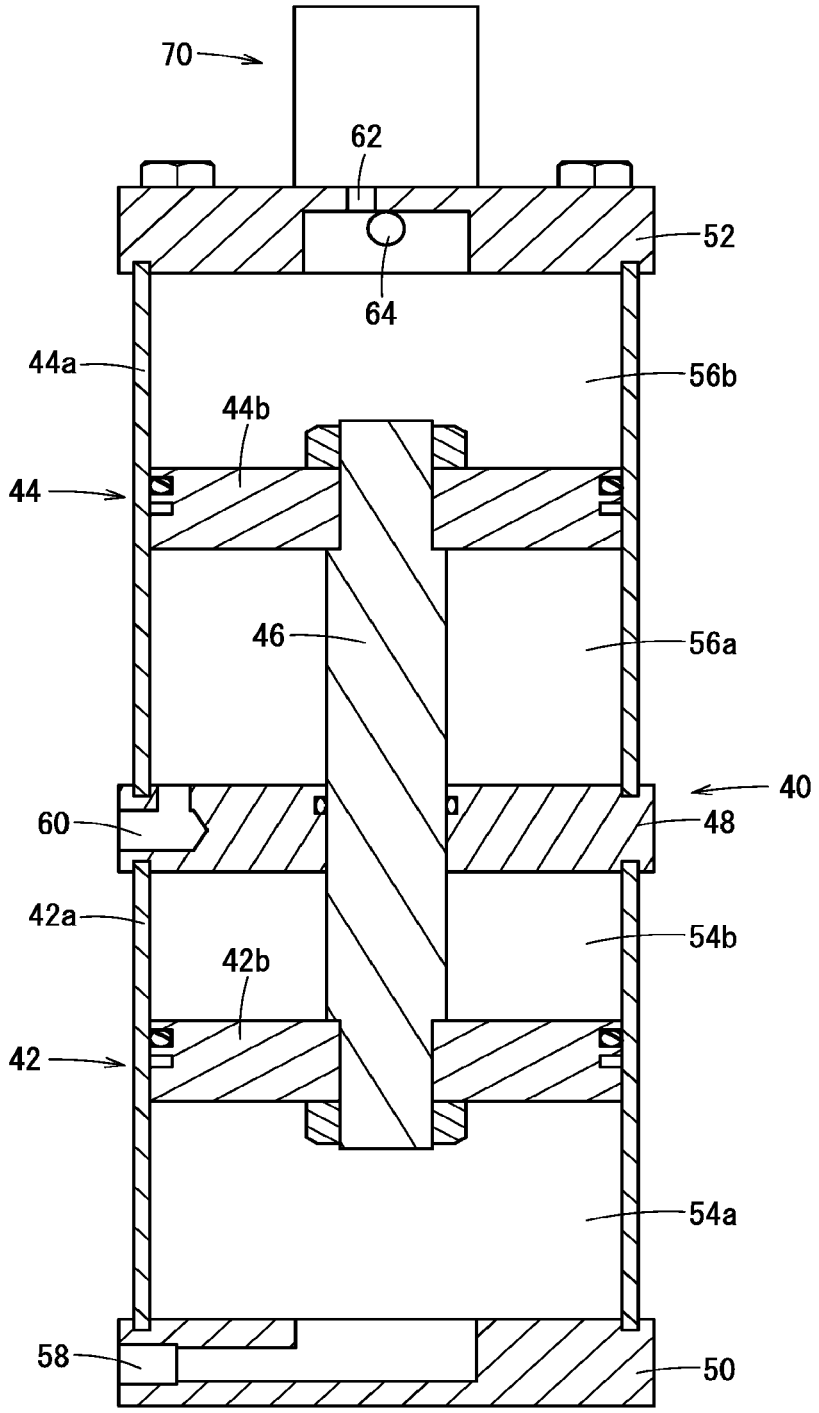
FIG. 9 is a sectional view taken along a line IX-IX of the pressure-booster output stabilizer according to the second embodiment of the present invention.

Referring next to FIGS. 8 and 9, a pressure-booster output stabilizer 40 according to a second embodiment of the present invention will be described. The second embodiment is different from the first embodiment in that the pressurized fluid from the fluid supply source is supplied to the first chamber of the first cylinder and also to the third chamber of the second cylinder. The second embodiment will also be described as being used in combination with the pressure booster 70 described above in the first embodiment, but the combined pressure booster is not limited to the above-described pressure booster 70.

The pressure-booster output stabilizer 40 includes a first cylinder 42 and a second cylinder 44 connected in series. The first cylinder 42 has a rectangular parallelepiped first cylinder tube 42*a* and a first piston 42*b* slidably arranged in a cylinder hole formed in the first cylinder tube 42*a*. The second cylinder 44 has a rectangular parallelepiped second cylinder tube 44*a* and a second piston 44*b* slidably arranged in a cylinder hole formed in the second cylinder tube 44*a*.

The first piston 42*b* is fixed to one end side of the piston rod 46, and the second piston 44*b* is fixed to the other end side of the piston rod 46. The first piston 42*b* and the second piston 44*b* move together with the piston rod 46 in the axial direction. The outside diameter of the first piston 42*b* is the same as the outside diameter of the second piston 44*b*.

A middle cover 48 is provided between the first cylinder tube 42*a* and the second cylinder tube 44*a*. A first end cover 50 is provided on an end side of the first cylinder tube 42*a* that is farther away from the middle cover 48, whereas a second end cover 52 is provided on an end side of the second cylinder tube 44*a* that is farther away from the middle cover 48. The pressure booster 70 is attached to the second end cover 52. The piston assembly formed of the first piston 42*b*, the second piston 44*b*, and the piston rod 46 is configured to be able to move between a position where the first piston 42*b* abuts against the first end cover 50 and a position where the first piston 42*b* abuts against the middle cover 48.

The inside of the cylinder hole of the first cylinder tube 42*a* is partitioned into a first chamber 54*a* on the first end cover 50 side and a second chamber 54*b* on the middle cover 48 side by the first piston 42*b*. The inside of the cylinder hole of the second cylinder tube 44*a* is partitioned into a third chamber 56*a* on the middle cover 48 side and a fourth chamber 56*b* on the second end cover 52 side by the second piston 44*b*.

The first end cover 50 is provided with a primary pressure supply first port 58 connected to the fluid supply source, and the middle cover 48 is provided with a primary pressure supply second port 60 connected to the fluid supply source. The pressurized fluid from the fluid supply source is supplied to the inlet port 80 of the pressure booster 70, and also to the primary pressure supply first port 58 and the primary pressure supply second port 60. Therefore, the pressure of the fluid supplied to the first chamber 54*a* of the first cylinder 42 via the primary pressure supply first port 58 and the pressure of the fluid supplied to the third chamber 56*a* of the second cylinder 44 via the primary pressure supply second port 60, are the same as that of the fluid supplied to the inlet port 80 of the pressure booster 70 (i.e., the primary pressure of the pressure booster 70).

The middle cover 48 is formed with a breathing port (not shown) that is open to the atmosphere, and the second chamber 54*b* of the first cylinder 42 is opened to the atmosphere through this breathing port. The second end cover 52 is provided with a secondary pressure supply port 62 that is directly connected to the outlet port 82 of the pressure booster 70. The pressurized fluid output from the pressure booster 70 is supplied to the fourth chamber 56*b* of the second cylinder 44 via the secondary pressure supply port 62. The pressure of the fluid at the secondary pressure supply port 62 is the same as the pressure of the fluid at the outlet port 82 of the pressure booster 70 (i.e., the secondary pressure of the pressure booster 70). Further, the second end cover 52 is provided with an output port 64, and the pressurized fluid in the fourth chamber 56*b* of the second cylinder 44 can be taken out from the output port 64 and supplied to an unillustrated fluid pressure device. The output port 64 is arranged at a position away from the secondary pressure supply port 62.

Here, the pressure of the first chamber 54*a* and the third chamber 56*a*, that is, the primary pressure of the pressure booster 70, is denoted by $P_1$, the pressure of the fourth chamber 56*b* at which the forces acting on the piston assembly are balanced is denoted by $P_2'$, and the secondary pressure set by the pressure booster 70 is dented by $P_2$. $P_2'$ can be determined based on $P_1$, the cross-sectional area of the first piston 42*b*, the cross-sectional area of the second piston 44*b*, and the cross-sectional area of the piston rod 46.

In order to maintain the pressure of the fluid taken out from the fourth chamber 56*b* at a value close to the secondary pressure $P_2$ set by the pressure booster 70, it is preferable that $P_2'$ be a value as close to $P_2$ as possible. Further, $P_2'$ needs to be $P_2$ or lower in order that the volume of the fourth chamber 56*b* can be restored after the piston assembly has moved until the volume of the fourth chamber 56*b* is minimized.

The pressure-booster output stabilizer 40 according to the present embodiment is thus configured, and its operation is the same as that of the pressure-booster output stabilizer 10 described above, so the description is omitted.

According to the pressure-booster output stabilizer 40 of the present embodiment, the primary pressure and the secondary pressure of the pressure booster 70 act on the piston assembly, and the pressurized fluid is taken out from the fourth chamber 56*b* to which (the fluid having) the secondary pressure is supplied. Accordingly, it is possible to output the pressurized fluid at a stable pressure close to the secondary pressure of the pressure booster 70. Further, since the operating speed of the pressure booster 70 is moderate, the amount of pressure fluid discharged from the discharge port 84 is reduced, whereby it is possible to reduce the consumption of pressure fluid and improve the durability of the pressure booster 70 as well.

The pressure-booster output stabilizer according to the present invention is not limited to the above-described embodiments, and may naturally have various configurations without departing from the essence and gist of the present invention.

What is claimed is:

1. A fluid device comprising a fluid pressure booster and a pressure-booster output stabilizer, wherein a primary pressure is applied to the fluid pressure booster and a higher boosted secondary pressure is outputted therefrom, wherein the pressure-booster output stabilizer comprises:

a first cylinder having therein a first chamber and a second chamber separated by a first piston;

a second cylinder having therein a third chamber and a fourth chamber separated by a second piston; and a piston rod configured to couple the first piston and the second piston, wherein the primary pressure is supplied to the first chamber, the secondary pressure is supplied to the fourth chamber, and a pressurized fluid is taken out from the fourth chamber.

2. The fluid device according to claim 1, wherein an outside diameter of the first piston is greater than an outside diameter of the second piston, and the second chamber and the third chamber are opened to atmosphere.

3. The fluid device according to claim 1, wherein the primary pressure is supplied to the third chamber, and the second chamber is opened to atmosphere.

4. The fluid device according to claim 3, wherein the second piston has a same outside diameter as the first piston.

5. The fluid device according to claim 1, wherein:

the first cylinder includes a first cylinder tube and a first end cover;

the second cylinder includes a second cylinder tube and a second end cover; and the first cylinder tube and the second cylinder tube are connected to each other via a middle cover.

6. The fluid device according to claim 5, wherein:

the first end cover is provided with a primary pressure supply port to which the primary pressure is supplied; and the second end cover is formed with a secondary pressure supply port and an output port, and the secondary pressure is supplied to the secondary pressure supply port.

* * * * *